US005671552A

United States Patent [19]

Pettibone et al.

[11] Patent Number: 5,671,552

[45] Date of Patent: Sep. 30, 1997

[54] ATHELETIC SHOE

[76] Inventors: Virginia G. Pettibone; Latesisa O. Pettibone, both of 17153 Pettibone La., Foley, Ala. 36535

[21] Appl. No.: 503,558

[22] Filed: Jul. 18, 1995

[51] Int. Cl.[6] ..... A43B 13/28; A43B 13/20

[52] U.S. Cl. ..... 36/27; 36/28; 36/29

[58] Field of Search ..... 36/3 R, 3 B, 28, 36/29, 27, 35 B, 38

[56] References Cited

U.S. PATENT DOCUMENTS

| | | | |
|---|---|---|---|
| 1,069,001 | 7/1913 | Guy | 36/29 |
| 4,267,648 | 5/1981 | Weisz | 36/28 |
| 4,417,407 | 11/1983 | Fukuoka | 36/29 |
| 4,670,995 | 6/1987 | Huang | 36/29 |
| 4,747,219 | 5/1988 | Ammendolea | 36/28 |
| 4,910,884 | 3/1990 | Lindh et al. | 36/28 |
| 4,999,932 | 3/1991 | Grim | 36/29 |
| 5,042,175 | 8/1991 | Ronen et al. | 36/28 |
| 5,191,727 | 3/1993 | Barry et al. | 36/107 |
| 5,224,278 | 7/1993 | Jeon | 36/29 |
| 5,279,051 | 1/1994 | Whatley | 36/25 R |
| 5,335,430 | 8/1994 | Fiso et al. | 36/29 |

FOREIGN PATENT DOCUMENTS

| | | | |
|---|---|---|---|
| 3012685 | 7/1993 | WIPO | 36/29 |

*Primary Examiner*—M. D. Patterson

*Attorney, Agent, or Firm*—Joseph N. Breaux

[57] ABSTRACT

An athletic shoe of the type having a bottom portion for aiding the user in jumping activities. The athletic shoe comprises: an upper portion for engaging the top of a foot on which the athletic shoe is worn; a bottom portion connected to the upper portion for engaging a sole of the foot; the bottom portion having at least an upper and a lower strata generally conforming to the outline of the sole of the foot and spaced from one another to define a cavity therebetween; a plurality of spring members mounted in the cavity and adapted for providing a spring action perpendicular to the sole; an air bladder disposed within the cavity; a rigid tube member forming an air passageway therein in connection between a first end opening and a second end having an intake aperture therethrough; the first end opening is in fluid connection with the air bladder and the intake aperture is exposed to the atmosphere; and a blocking mechanism functionally connected to the rigid tube member in a manner to block the passage of air through the intake aperture when the blocking mechanism is in a closed position and to allow the passage of air through the intake aperture when the blocking mechanism is in an open position.

15 Claims, 2 Drawing Sheets

ATHELETIC SHOE

TECHNICAL FIELD

The present invention relates to footwear and more particularly to athletic footwear having a sole for increasing the jumping ability of the user that is especially advantageous to basketball players and the like.

BACKGROUND ART

Conventional athletic shoes have soles comprised of several layers of resilient material designed to provide a cushioning effect for the wearer. Typically the tread surface, which may be of a rubbery material and molded with a traction design, is bonded to a relatively light inner cushioning layer which may be of a foamed plastic or elastomeric material. Some athletic shoes have incorporated spring mechanisms or fluid filled zones within the soles to increase the cushioning effect of the sole.

However, while these various configurations provide a cushion protecting the user's foot they do not aide in the user in activities requiring jumping such as in basketball. In fact by design these soles are designed to absorb forces exerted against them.

It would be a benefit, therefore, to have an athletic shoe with spring members for providing a spring action perpendicular to the sole. It would be a further benefit to have the spring members located under the ball of the user's foot to react to forces exerted in the jumping action of the users. It would also be a benefit to have an air bladder which may be filled with air thus reducing the spring action of the springs when the user is not involved in jumping activities.

GENERAL SUMMARY DISCUSSION OF INVENTION

It is thus an object of the invention to provide an athletic shoe that has spring members in the sole providing a spring action perpendicular to the sole of the athletic shoe.

It is a further object of the invention to provide an athletic shoe that has spring members located below the ball of the user's foot to aide the user in jumping activities.

It is a still further object of the invention to provide an athletic shoe that has an adjustable air bladder which can negate the spring action of the spring members when the user is not involved in jumping activities.

Accordingly, an athletic shoe of the type having a bottom portion for aiding the user in jumping activities is provided. The athletic shoe comprises: an upper portion for engaging the top of a foot on which the athletic shoe is worn; a bottom portion connected to the upper portion for engaging a sole of the foot; the bottom portion having at least an upper and a lower strata generally conforming to the outline of the sole of the foot and spaced from one another to define a cavity therebetween; a plurality of spring members mounted in the cavity and adapted for providing a spring action perpendicular to the sole; an air bladder disposed within the cavity; a rigid tube member forming an air passageway therein in connection between a first end opening and a second end having an intake aperture therethrough; the first end opening is in fluid connection with the air bladder and the intake aperture is exposed to the atmosphere; and a blocking mechanism functionally connected to the rigid tube member in a manner to block the passage of air through the intake aperture when the blocking mechanism is in a closed position and to allow the passage of air through the intake aperture when the blocking mechanism is in an open position.

The top portion may be manufactured from canvas or cloth. Preferably, the top portion is manufactured from leather in sections stitched together. The bottom portion may be a foamed plastic or elastomeric material. The bottom portion may be connected to the upper portion by stitching or gluing.

The upper and lower strata of the bottom portion are interposed and connected by gluing to form a cavity therein. The bottom portion has a toe section and a heel section. Preferably, the cavity is formed in the toe section and is substantially aligned with the ball of the user's foot.

The spring members may be disc springs, elliptical spring or a Belleville spring. Preferably, the spring members are helical springs arranged in closely spaced side by side relation within the cavity.

The rigid tube member may be manufactured from any hard, light weight material which will not deform under the weight and force exerted by the user. The air intake aperture may be formed by the end of rigid tube member or through the side wall of the rigid tube member. The second end of the rigid tube member may have external threading.

Preferably, the second end of the rigid tube member forms a flange end having a concentric plug extending therefrom, the concentric plug having an outside diameter less than the outside diameter of the flange end. More preferably, the second end has external threading and the intake aperture is formed between the external threading and the flange end.

The second end of the rigid tube member may extend beyond the sidewall of the bottom portion. Preferably, the second end of the rigid tube member extends beyond the sidewall of the heel section of the bottom portion.

The blocking mechanism may be any type valve known in the art which may be used to block the air passageway from the air bladder to the air intake aperture. Preferably, the blocking mechanism is a sleeve member having a first open end and a second end forming an orifice therethrough. The first open end has internal threading adapted for meshing with the external threading of the second end of the rigid tube member to form an air tight seal. The orifice has an inside diameter adapted for passing the concentric plug in a manner such that an air tight seal is formed when the sleeve member is in the closed position.

In another preferred embodiment, the bottom portion further defines a conduit forming a tube pathway therein having an initial end open to the cavity and a terminal end open to the sidewall of the bottom portion. More preferably, the terminal end is open to the sidewall of the heel section.

Preferably, the rigid tube member is disposed within the tube conduit by gluing. The second end of the rigid tube member extending beyond the terminal end of the conduit. Preferably, a grommet forming a sleeve pathway therein, in connection between an interior end opening and a lip end opening, forms the terminal end of the conduit. The sleeve pathway has an inside diameter adequate for passing the sleeve member of the blocking mechanism therein. The sleeve member is rotatably disposed within the sleeve pathway of the grommet.

In use the spring members provide a spring action perpendicular to the sole of the user's foot. To increase the spring action the user may open the blocking mechanism thus allowing air to be expelled from the air bladder when force is exerted on the cavity. When air is expelled from the air bladder the spring members length of travel is extended increases the reactive force of the springs. When it is desired to decrease the reactive force of the spring members the user removes all force from the cavity and the air bladder, with the blocking mechanism open, permitting air at atmospheric pressure to fill the air bladder. The blocking mechanism is then closed maintaining the air volume within the air bladder thus reducing the travel of the spring members when a force is exerted upon them.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
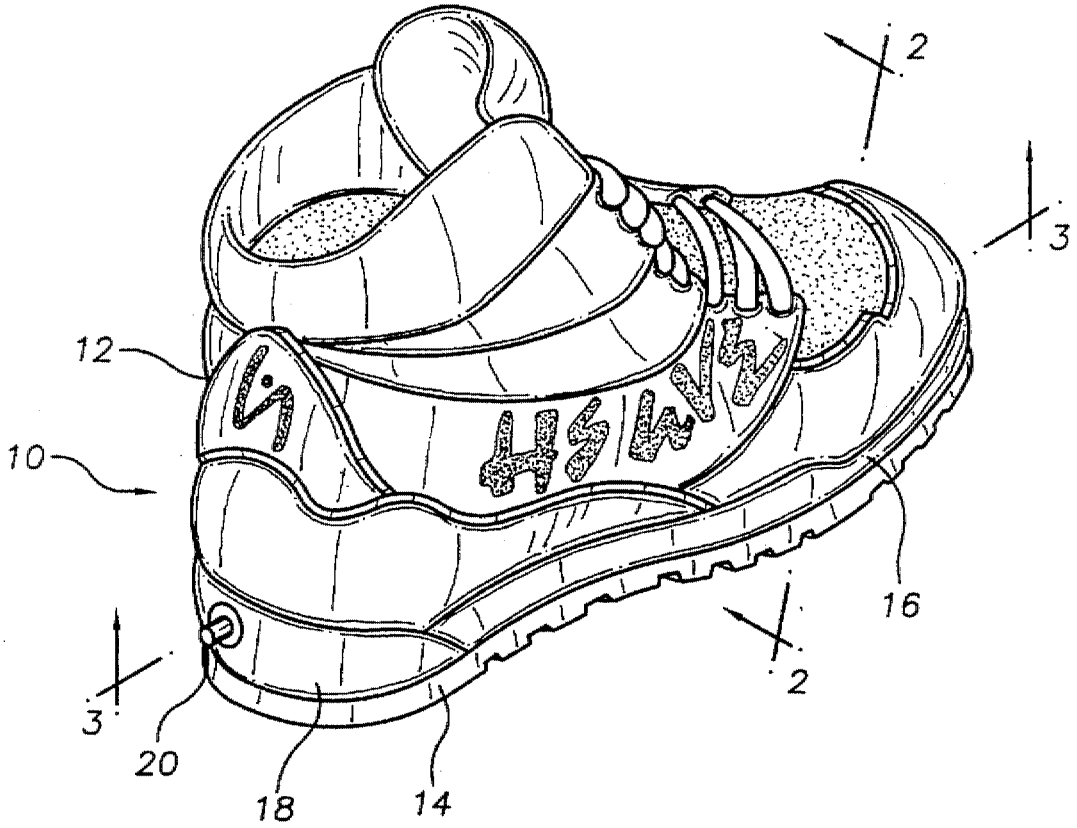
FIG. 1 is a plan view of an exemplary embodiment of the athletic shoe of the present invention.

FIG. 1 shows an exemplary embodiment of the athletic shoe of the present invention generally designated by the numeral 10. The figure shows upper portion 12 for engaging the top of a foot of the user, bottom portion 14 forming toe section 16 and heel section 18 for engaging the sole of the user's foot and blocking mechanism 20. Upper portion 12 is manufactured from leather sections stitched together to provide a form fitted cover for the foot of the user. Bottom portion 14 is formed of a firm, pliable rubber and connected to upper portion 12 by gluing.

Figure 2:
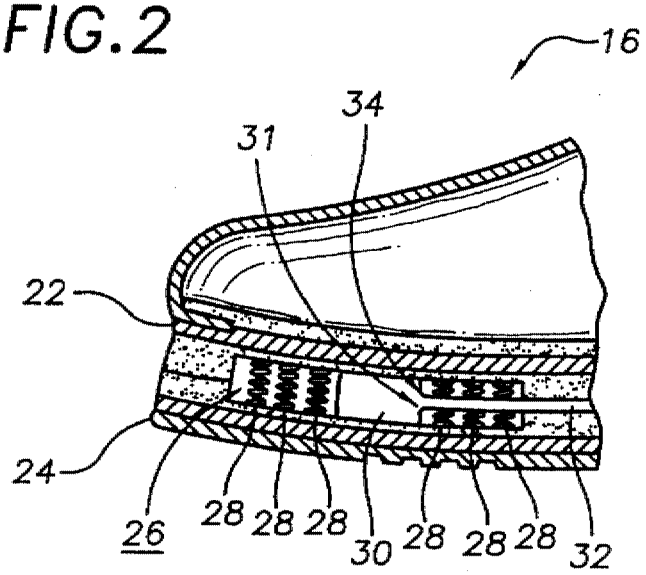
FIG. 2 is a cross-sectional, side view of the toe section along the line 2—2 shown in FIG. 1.

FIG. 2 is cross-sectional view of toe section 16 of bottom portion 14 along the line 2—2 shown in FIG. 1. The figure shows upper strata 22, lower strata 24, cavity 26, helical springs 28, air bladder 30 and rigid tube member 32 having a first end opening 34.

Upper strata 22 and lower strata 24 are shaped to conform to the outline of a sole of a foot and are connected by gluing to form cavity 26. Cavity 26 is formed beneath the ball of the foot of the user. Helical springs 28 have an end molded within lower strata 24 the opposing ends are molded within upper strata 22. Air bladder 30 is formed of a flexible rubber impermeable to air and is disposed between two sections of helical springs 28. Air bladder 30 is enclosed on all sides having a single inlet 31. Tube member 32 is formed of a rigid hard plastic. First end opening 34 of tube member 32 is tapered and connected to inlet 31 of air bladder 30.

Figure 3:
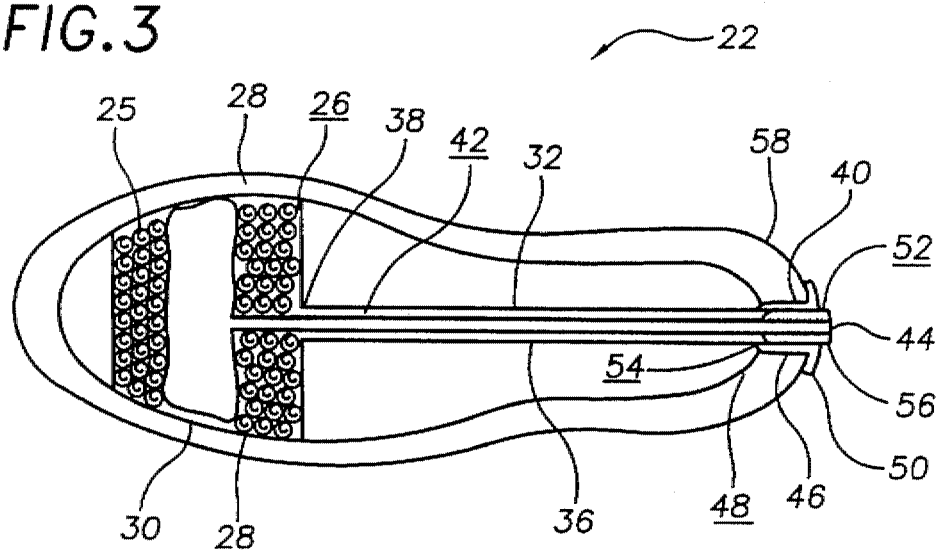
FIG. 3 is a cross-sectional, bottom view of the upper strata along the line 3—3 shown in FIG. 1.

FIG. 3 is a cross-sectional view of upper strata 22 of bottom portion 14 along the line 3—3 shown in FIG. 1. The figure shows cavity 26, three sections of helical springs 28, air bladder 30, conduit 36 having an initial end 38 and a terminal end 40 forming a tube pathway 42 therebetween, rigid tube member 32, second end of tube member 44, grommet 46 having an interior end opening 48 and a lip end 50 forming a lip opening 52, sleeve pathway 54, sleeve member 56 of blocking mechanism 20 (FIG. 1) and heel sidewall 58.

Conduit 36 is a void defined by upper strata 22 and lower strata 24 forming a concentric tube pathway 42 having an inside diameter compatible with the outside diameter of tube member 32. Tube member 32 is glued within tube pathway 42. Grommet 46 is formed of a rigid plastic material and is glued within terminal end 40 of conduit 36. Sleeve pathway 54 has an inside diameter suitable for rotatably passing sleeve member 56.

Figure 4:
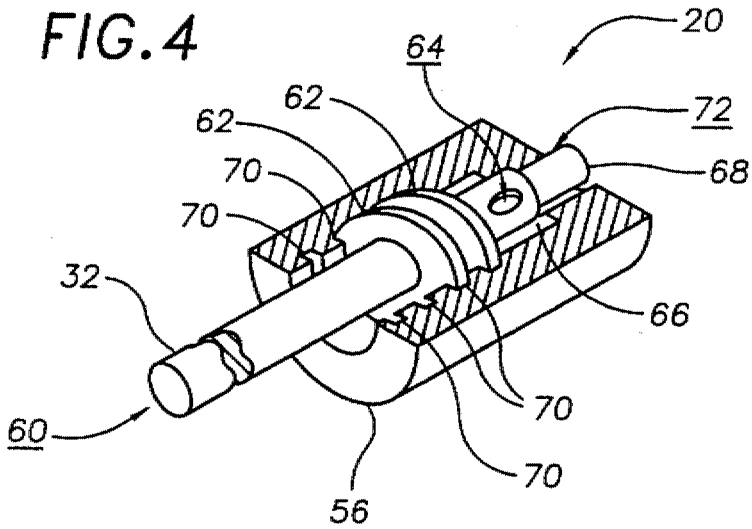
FIG. 4 is a cross-sectional, isometric view of the blocking mechanism in the closed position.

FIG. 4 is a cut away view of blocking mechanism 20 in the closed position. The figure shows tube member 32, air passageway 60, external threading 62, intake aperture 64, flange end 66, concentric plug 68, sleeve member 56, internal threading 70 and orifice 72.

When the blocking mechanism is in the closed position concentric plug 68 is disposed into orifice 72 forming an air tight seal. External threads 62 on tube member 32 mesh with internal threads 70 of sleeve member 56 forming an air tight seal.

Figure 5:
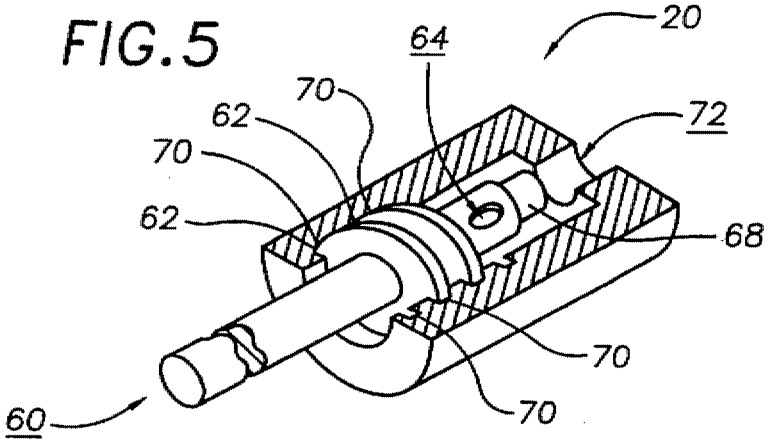
FIG. 5 is a cross-sectional, isometric view of the blocking mechanism in the open position.

FIG. 5 is a cut away view of blocking mechanism 20 in the open position. The figure shows concentric plug 68 withdrawn from orifice 72 and external threads 62 meshing with internal threads 70 forming an air tight seal. When pressure is exerted on air bladder 30 (FIG. 3) the contained air passes through air passageway 60 and is expelled through intake aperture 64 escaping through orifice 72. When pressure is released from air bladder 30 (FIG. 3) air passes through orifice 72, intake aperture 64 and air passageway 60 filling air bladder 30 (FIG. 3) to atmospheric pressure.

It can be seen from the preceding description that an athletic shoe having a sole incorporating spring members beneath the ball of the user's foot for aiding the user in jumping activities and having an air bladder which may reduce the spring action when the user is not involved in jumping activities has been provided.

It is noted that the embodiment of the athletic shoe described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An athletic shoe, comprising:

an upper portion for engaging the top of a foot on which said athletic shoe is worn;

a bottom portion connected to said upper portion for engaging a sole of said foot, said bottom portion having at least an upper and a lower strata generally conforming to the outline of said sole and spaced from one another to define a cavity therebetween, said cavity being positioned in alignment beneath a ball of said foot;

a plurality of helical spring members mounted in said cavity and adapted for providing a spring action perpendicular to said sole, each of said plurality of spring members having a first end molded within said lower strata and a second end molded within said upper strata;

an air bladder disposed within said cavity;

a rigid tube member forming an air passageway therein in connection between a first end opening and a second end having an intake aperture therethrough, said first end opening being in fluid connection with said air bladder and said intake aperture being exposed to the atmosphere; and a valve connected to said rigid tube member in a manner to block the passage of air through said intake aperture when said valve is in a closed position and to allow the passage of air through said intake aperture when said valve is in an open position;

said air bladder and said rigid tube member being disposed within said cavity in a manner such that said plurality of springs are divided into three sections of multiple springs.

2. The athletic shoe of claim 1, wherein:

said second end of said rigid tube member has a flange end;

a concentric plug extend from said flange end; and said concentric plug has an outside diameter less than an outside diameter of said flange end.

3. The athletic shoe of claim 2, wherein:

said second end of said rigid tube member has external threading; and said rigid tube member forms said intake aperture between said external threading and said flange end.

4. The athletic shoe of claim 3, wherein:

said second end of said rigid tube member extends beyond a sidewall of said bottom portion.

5. The athletic shoe of claim 4, wherein:

said second end of said rigid tube member extends beyond said sidewall of said heel section of said bottom portion.

6. The athletic shoe of claim 5, wherein:

said valve is a sleeve member having a first open end and a second end forming an orifice therethrough;

said first open end having internal threading adapted for meshing with said external threading of said second end of said rigid tube member; and said orifice having an inside diameter adapted for passing said concentric plug in a manner such that a substantially air tight seal is formed when said sleeve member is in said closed position.

7. An athletic shoe, comprising:

an upper portion for engaging the top of a foot on which said athletic shoe is worn;

a bottom portion connected to said upper portion for engaging a sole of said foot, said bottom portion having at least an upper and a lower strata generally conforming to the outline of said sole and spaced from one another to define a cavity therebetween, said cavity being positioned in alignment beneath a ball of said foot;

a plurality of helical spring members arranged and mounted in closely spaced side by side relation within said cavity and adapted for providing a spring action perpendicular to said sole, each of said plurality of spring members having a first end molded within said lower strata and a second end molded within said upper strata;

an air bladder disposed within said cavity;

a rigid tube member forming an air passageway therein in connection between a first end opening and a second end having an intake aperture therethrough, said first end opening being in fluid connection with said air bladder and said intake aperture being exposed to the atmosphere;

said second end having a flange end and external threading;

said intake aperture being formed between said external threading and said flange end;

said flange end having a concentric plug extending therefrom having an outside diameter less than an outside diameter of said flange end; and a valve connected to said rigid tube member in a manner to block the passage of air through said intake aperture when said valve is in a closed position and to allow the passage of air through said intake aperture when said valve is in an open position.

8. The athletic shoe of claim 7, wherein:

said valve is a sleeve member having a first open end and a second end forming an orifice therethrough;

said first open end having internal threading adapted for meshing with said external threading of said second end of said rigid tube member; and said orifice having an inside diameter adapted for passing said concentric plug in a manner such that a substantially air tight seal is formed when said sleeve member is in said closed position.

9. The athletic shoe of claim 8, wherein said bottom portion further includes:

a conduit forming a tube pathway therein having an initial end open to said cavity and a terminal end open to a sidewall of said bottom portion, said conduit formed by said upper and lower strata.

10. The athletic shoe of claim 9, furthering including:

a grommet forming a sleeve pathway therein in connection between an interior end opening and a lip end opening;

said grommet being disposed within said terminal end of said conduit; and said lip end being rigidly connected to said sidewall of said bottom portion.

11. The athletic shoe of claim 10, wherein:

said rigid tube member is disposed within said conduit.

12. The athletic shoe of claim 11, wherein:

said second end of said rigid tube extends beyond said sidewall of said bottom portion.

13. The athletic shoe of claim 12, wherein:

said second end of said rigid tube extends beyond said sidewall of said heel section of said bottom portion.

14. An athletic shoe, comprising:

an upper portion for engaging the top of a foot on which said athletic shoe is worn;

a bottom portion having a toe section and a heel section connected to said upper portion for engaging a sole of said foot, said bottom portion having at least an upper and a lower strata generally conforming to the outline of said sole and spaced from one another to define a cavity therebetween within the toe section that is substantially aligned with a ball of said foot;

said bottom portion forming a conduit having a tube pathway therein in connection between an initial end open to said cavity and a terminal end open to a sidewall of said heel section of said bottom portion;

a plurality of helical spring members arranged and mounted in closely spaced side by side relation within said cavity and adapted for providing a spring action perpendicular to said sole;

an air bladder disposed within said cavity;

a rigid tube member disposed within said tube pathway of said conduit;

said rigid tube member forming an air passageway therein in connection between a first end opening and a second end having an intake aperture therethrough;

said first end opening being in fluid connection with said air bladder and said intake aperture being exposed to the atmosphere;

said second end extending beyond said sidewall of said heel section;

said second end has a flange end and external threading;

said intake aperture being formed between said external threading and said flange end;

said flange end having a concentric plug extending therefrom having an outside diameter less than an outside diameter of said flange end; and a valve comprising a sleeve member having a first open end and a second end forming an orifice therethrough;

said first open end having internal threading adapted for meshing with said external threading of said second end of said rigid tube member;

said orifice having an inside diameter adapted for passing said concentric plug in a manner such that a substantially air tight seal is formed when said sleeve member is in said closed position; and said sleeve member is functionally connected to said rigid tube member in a manner to block the passage of air through said intake aperture when said valve is in a closed position and to allow the passage of air through said intake aperture when said valve is in an open position;

said air bladder and said rigid tube member being disposed within said cavity in a manner such that said plurality of springs are divided into three sections of multiple springs.

15. The athletic shoe of claim 14, further including:

a grommet forming a sleeve pathway therein in connection between an interior end opening and a lip end opening;

said grommet being disposed within said terminal end; and said lip end being rigidly connected to said sidewall of said bottom portion.

* * * * *